US011829102B2

(12) United States Patent
Yamashita et al.

(10) Patent No.: US 11,829,102 B2
(45) Date of Patent: Nov. 28, 2023

(54) TONER CLASSIFICATION APPARATUS AND TONER PRODUCTION METHOD

(71) Applicant: CANON KABUSHIKI KAISHA, Tokyo (JP)

(72) Inventors: Daisuke Yamashita, Chiba (JP); Yuichi Mizo, Ibaraki (JP); Junichi Tamura, Ibaraki (JP); Ran Wakayama, Kanagawa (JP); Yutaro Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 17/344,871

(22) Filed: Jun. 10, 2021

(65) Prior Publication Data

US 2021/0397104 A1 Dec. 23, 2021

(30) Foreign Application Priority Data

Jun. 22, 2020 (JP) ..... 2020-107170
May 14, 2021 (JP) ..... 2021-082036

(51) Int. Cl.
*G03G 9/08* (2006.01)
*B07B 11/06* (2006.01)
*B07B 7/083* (2006.01)

(52) U.S. Cl.
CPC ..... *G03G 9/0817* (2013.01); *B07B 11/06* (2013.01); *B07B 7/083* (2013.01)

(58) Field of Classification Search
CPC .... G03G 9/0815; G03G 9/0817; B07B 11/06; B07B 7/083

(Continued)

(56) References Cited

U.S. PATENT DOCUMENTS 7,438,245 B2 10/2008 Kawamoto et al. ..... 241/40
2005/0164115 A1* 7/2005 Tamura ..... G03G 9/081 430/110.4
2006/0032952 A1 2/2006 Kawamoto et al. ..... 241/40

FOREIGN PATENT DOCUMENTS

JP 2001-201890 7/2001
JP 2006-055838 3/2006

(Continued)

OTHER PUBLICATIONS

Masayuki; Kakimoto, "Air Current Type Classifier, Apparatus for Producing Small Particle, and Method for Producing Small Particle" (English Translation), Mar. 2, 2006, worldwide.espacenet.com (Year: 2006).*

*Primary Examiner* — Michael McCullough
*Assistant Examiner* — Molly K Devine
(74) *Attorney, Agent, or Firm* — Venable LLP

(57) ABSTRACT

Toner classification apparatus comprising classification rotor comprising a plurality of vanes extending from rotation center side of classification rotor to outer circumference side of classification rotor; the plurality of vanes are disposed with prescribed gaps established between vanes; gaps form opening facing rotation center region of classification rotor; each of vanes is disposed such that portion of vane away from of center of rotation of classification rotor is located on more upstream side in a direction of rotation of classification rotor than portion of vane closer to center of rotation of classification rotor; each of vanes has elbow; and in a horizontal cross section provided by sectioning classification rotor in a rotational axis perpendicular direction of classification rotor, shape of vane satisfies prescribed formulae, as well as toner production method comprising classification step of carrying out classification process on particles to be classified by using toner classification apparatus.

10 Claims, 6 Drawing Sheets

(58) Field of Classification Search
USPC ..... 430/137.2
See application file for complete search history.

(56) References Cited

FOREIGN PATENT DOCUMENTS

| | | |
|---|---|---|
| JP | 2008-026457 | 2/2008 |
| JP | 2010-160374 | 7/2010 |
| JP | 2011-237816 | 11/2011 |

* cited by examiner

θ2:20°

[L3-L2]/[L1-L2]=0.76

θ2:30°

[L3-L2]/[L1-L2]=0.76

θ2:30°

[L3-L2]/[L1-L2]=0. 64

TONER CLASSIFICATION APPARATUS AND TONER PRODUCTION METHOD

BACKGROUND OF THE INVENTION

Field of the Invention

The present disclosure relates to a toner classification apparatus that is used in an electrophotographic system, an electrostatic recording system, and a toner jet system, and to a toner production method.

Description of the Related Art

In recent years, full color electrophotographic copiers have become widely disseminated and have also begun to be used in the commercial printing market. The commercial printing market requires high speeds, high image quality, and high productivity, while accommodating a broad range of media (paper types). With regard to toner, an increased image quality can be pursued through stabilization of the developing performance and transferability based on, inter alia, a stabilization of the charging performance provided by toner that has a small particle size and a sharp particle size distribution.

The melt-kneading/pulverization method is known as one of the common toner production methods. A specific example of a toner particle production method using the melt-kneading/pulverization method is as follows. Toner starting materials, e.g., binder resin, colorant, release agent, and so forth, are melt-kneaded followed by cooling and solidification and then microfine-sizing of the kneadate using pulverization means to obtain a toner particle. As necessary, this is followed by, e.g., classification into a desired particle size distribution, adjustment of the circularity by toner particle spheronization using a heat treatment, and addition of a fluidizing agent such as inorganic fine particles, to produce the toner.

A variety of pulverization apparatuses are used as kneadate pulverization means. For example, the mechanical pulverization apparatus in Japanese Patent Application Laid-open No. 2011-237816 is a mechanical pulverization apparatus that is provided with a casing having an outlet port and an inlet port for the material to be pulverized. The following are provided within this casing: a rotor supported on a central rotational axle and having on its outer peripheral surface a plurality of protruded portions and depressed portions, and a fixed element which is disposed to the outside of this rotor at a prescribed gap from the outer peripheral surface of the rotor and which has on its inner peripheral surface a plurality of protruded portions and depressed portions. While a material to be pulverized is being carried on an air flow from the inlet port to the outlet port and is passing through a processing space, where the rotor and fixed element face each other, the material to be pulverized is pulverized by impact with the protruding portions or depressed portions of the rotor or fixed element.

In addition, particles generated during the pulverization step and having too small diameter are admixed in the pulverized material provided by pulverization, by the pulverization apparatus, to the desired particle diameter. These particles having too small diameter, when present in toner, create problems for the electrophotographic process, e.g., fogging and so forth, and due to this the particles having too small diameter are generally removed by a classification process. The following, for example, are known as toner production methods that have a classification process that uses a classification apparatus: the toner production method described in Japanese Patent Application Laid-open No. 2001-201890, which uses an air flow classification apparatus that employs the Coanda effect, and the toner production method described in Japanese Patent Application Laid-open No. 2008-26457, which uses a centrifugal wind force classifier.

When a centrifugal wind force classifier is used, the pulverized material—which comprises the particles to be classified and derives from the toner starting material kneadate—is transported from the inlet port to the vicinity of the outer circumference of a classification rotor by an air flow that is directed from the outer circumference side to the inside of the classification rotor. Due to the rotation of the classification rotor, a centrifugal force is applied at the outer circumference of the classification rotor. The centrifugal force acting on the particles to be classified is a force directed to the outside of the classification rotor and is proportional to the particle weight, and due to this the centrifugal force acting on the particles having too small diameter in the particles to be classified is smaller than the drag imparted by the air flow directed from the outer circumference side to the inside of the classification rotor. As a consequence, classification proceeds as follows: a classified material is obtained by removal of the particles having too small diameter from the particles to be classified by passage between the vanes of the classification rotor and recovery by means for recovering particles having too small diameter that communicates with the inside of the classification rotor, and the classified material from which the particles having too small diameter have been thusly removed is recovered using classified material recovery means disposed to the outside of the classification rotor.

Japanese Patent Application Laid-open No. 2010-160374 also proposes a toner production method, which uses classification means that has a plurality of vanes lined up at a certain interposed gap on the same circumference, with each vane making an angle θ of from 20° to 65° with respect to the straight line connecting the center of the classification rotor with the tip of the vane. The classification means used in this production method causes the generation of a vortex by dividing the air entering between the vanes from the outside of the rapidly rotating classification rotor into a component in the direction of the center of rotation and a component expelled to the outside of the classification rotor.

SUMMARY OF THE INVENTION

As noted above, the classification process is performed by adjusting the balance between the drag force and centrifugal force acting on the particles to be classified. However, in some cases particles that should not be taken in as particles having too small diameter also end up being suctioned off and removed in error; this occurs due to factors such as the occurrence of turbulence in the air flow in the classification apparatus, the occurrence of aggregation between the particles to be classified, the occurrence of variability in the velocity when the particles to be classified approach the classification rotor, and the occurrence of a vortex between the vanes of the classification rotor. As the average particle diameter of the particles to be classified approaches the particle diameter of the particles having too small diameter, which are the particles that should be removed by the classification step, the ratio of removal due to erroneous suctioning off becomes larger, and as a result a reduction in the yield for the classification step has been observed when smaller toner particle sizes are pursued.

It is thought that the vortex generated in the toner production method described in Japanese Patent Application Laid-open No. 2010-160374 is generated by the configuration along the vanes. When the angle θ is present, a vortex is generated more at the outer side of the classification rotor than for a classification rotor which is disposed on the aforementioned radial straight line, and as a consequence the ratio of erroneous suctioning off of the particles to be classified is smaller and an improved yield has been observed. However, when this angle θ becomes too large, the vane-to-vane gap on the inner side of the classification rotor becomes too narrow, and as a consequence pass-through by the particles having too small diameter are also impeded and the inability to achieve a satisfactory removal of the particles having too small diameter has also been observed.

As noted above, smaller particle sizes are being required of toner in order to boost the image quality. The dominant factor for the particle diameter of the ultimately obtained toner is the particle diameter of the pulverized material yielded by the pulverization step after the mixture of toner starting materials has been melt-kneaded. The particle size of the pulverized material thus has to be reduced in order to reduce the particle size of the toner. The classification step is a step in which the particles having too small diameter, which may be a problematic factor for the electrophotographic process, are removed. However, when the toner particle size is reduced, the average particle diameter of the pulverized material becomes close to the particle size of the particles having too small diameter, which are the particles that are to be removed by the classification step. As a consequence, the problem arises of a reduction in the yield due to the concomitant removal, partly as particles having too small diameter, of particles that should not be removed because they have a diameter suitable for the toner.

The present disclosure solves the problem by providing a toner classification apparatus and toner production method that demonstrate an excellent yield even in the production of small diameter toner.

The present disclosure is a toner classification apparatus comprising a classification rotor, wherein the classification rotor comprises a plurality of vanes that extend from a side of a center of rotation of the classification rotor to an outer circumference side of the classification rotor;

the plurality of vanes are disposed with prescribed gaps established between the vanes;

the gaps form an opening that faces a region of the center of rotation of the classification rotor;

each of the vanes is disposed such that a portion of a vane away from of the center of rotation of the classification rotor is located on more upstream side in a direction of rotation of the classification rotor than a portion of the vane closer to the center of rotation of the classification rotor;

each of the vanes has an elbow; and in a horizontal cross section provided by sectioning the classification rotor in a direction perpendicular to a rotational axis of the classification rotor, (i) an angle θ1 is formed between a straight line that connects the center of rotation of the classification rotor to the vane end on the side of the center of rotation, and a straight line that connects the vane end on the side of the center of rotation to the vane elbow, with the angle θ1 being from 30° to 65°, (ii) using L1 for a distance from the center of rotation of the classification rotor to the vane end on the outer circumference side, L2 for a distance from the center of rotation of the classification rotor to the vane end on the side of the center of rotation, and L3 for a distance from the center of rotation of the classification rotor to the vane elbow, formula below is satisfied:

$$0.65 \leq (L3-L2)/(L1-L2) \leq 0.85,$$

(iii) an angle θ2 is formed between a straight line that connects the vane end on the side of the center of rotation to the vane elbow, and a straight line that connects the vane elbow to the vane end on the outer circumference side, with the angle θ2 being from 5° to 25°, and (iv) a sum of the θ1 and the θ2 is from 55° to 85°.

The present disclosure is a toner production method comprising a classification step of carrying out a classification process on particles to be classified by using a toner classification apparatus, wherein the toner classification apparatus comprises a classification rotor, the classification rotor comprises a plurality of vanes that extend from a side of a center of rotation of the classification rotor to an outer circumference side of the classification rotor, the plurality of vanes are disposed with prescribed gaps established therebetween, the gaps form an opening that faces a region of the center of rotation of the classification rotor, each of the vanes is disposed such that a portion of a vane away from of the center of rotation of the classification rotor is located on more upstream side in a direction of rotation of the classification rotor than a portion of the vane closer to the center of rotation of the classification rotor;

each of the vanes has an elbow, and in a horizontal cross section provided by sectioning the classification rotor in a direction perpendicular to a rotational axis of the classification rotor, (i) an angle θ1 is formed between a straight line that connects the center of rotation of the classification rotor to the vane end on the side of the center of rotation, and a straight line that connects the vane end on the side of the center of rotation with the vane elbow, with the angle θ1 being from 30° to 65°, (ii) using L1 for a distance from the center of rotation of the classification rotor to the vane end on the outer circumference side, L2 for a distance from the center of rotation of the classification rotor to the vane end on the side of the center of rotation, and L3 for a distance from the center of rotation of the classification rotor to the vane elbow, formula below is satisfied:

$$0.65 \leq (L3-L2)/(L1-L2) \leq 0.85,$$

(iii) an angle θ2 is formed between a straight line that connects the vane end on the side of the center of rotation to the vane elbow, and a straight line that connects the vane elbow to the vane end on the outer circumference side, with the angle θ2 being from 5° to 25°, and (iv) a sum of the θ1 and the θ2 is from 55° to 85°.

According to the present disclosure, a toner classification apparatus and toner production method that demonstrate an excellent yield even in the production of small diameter toner can be provided.

Further features of the present invention will become apparent from the following description of exemplary embodiments with reference to the attached drawings.

DESCRIPTION OF THE EMBODIMENTS

Figure 1:
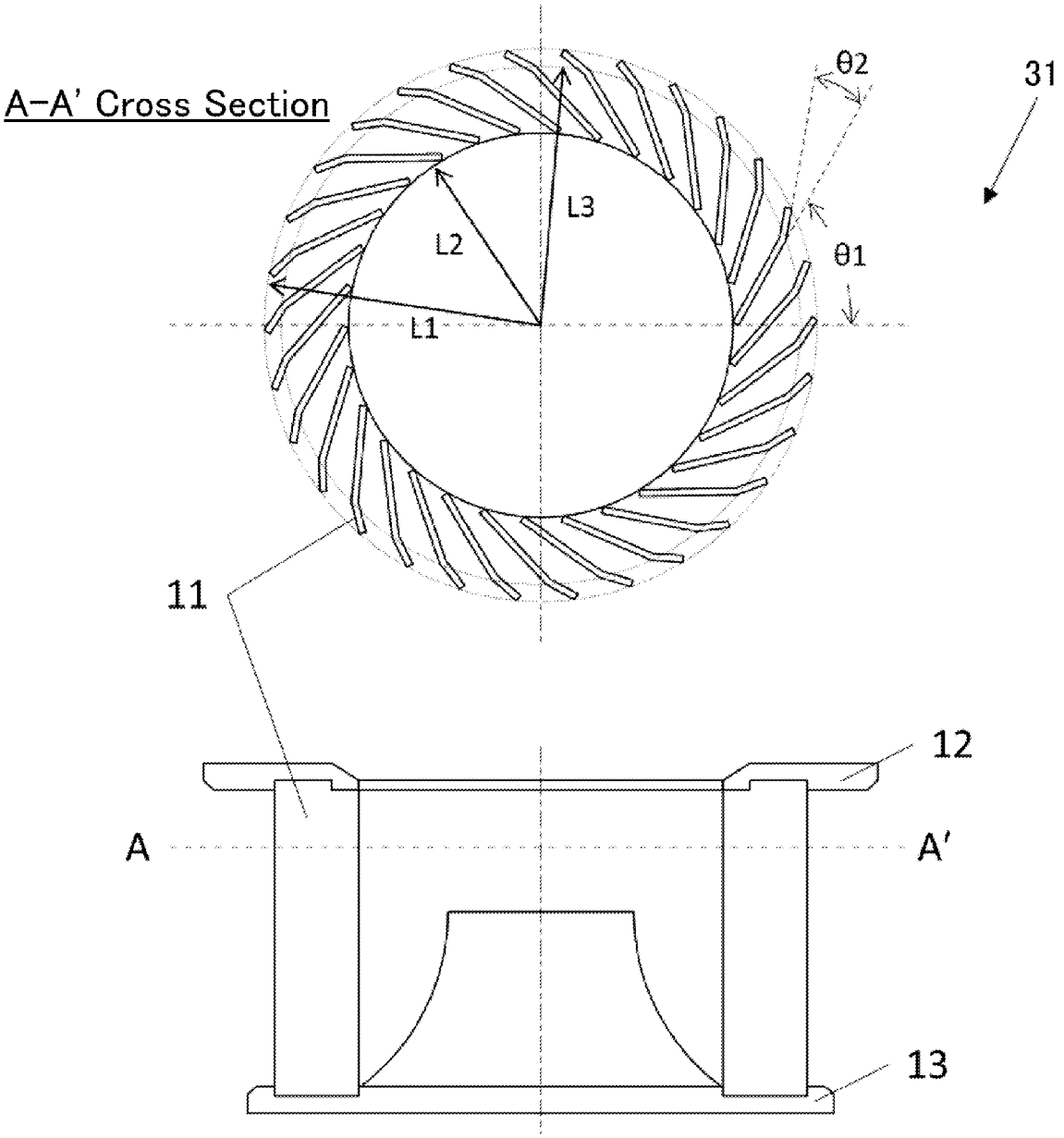
FIG. 1 is a schematic diagram of a classification rotor.

Unless specifically indicated otherwise, the expressions "from XX to YY" and "XX to YY" that show numerical value ranges refer in the present disclosure to numerical value ranges that include the lower limit and upper limit that are the end points. The reference numerals in the drawings are as follows.

11. vane, 12. upper part of classification rotor frame, 13. lower part of classification rotor frame, 31. classification rotor, 32. dispersion rotor, 33. dispersion hammer, 34. introduction port for particles to be classified, 35. supply means for particles to be classified, 36. guide means, 37. classified material take-off port, 38. liner, 39. particles having too small diameter discharge port, 51. guide means support member FIG. 1 provides a schematic drawing of a classification rotor that is provided in a toner classification apparatus. This classification rotor 31 has a plurality of vanes 11 that run from the side of the center of rotation of the classification rotor 31 to the outer circumference side thereof. This plurality of vanes 11 are disposed with prescribed gaps established therebetween. The gaps form openings that face the region of the center of rotation of the classification rotor 31. Each of the vanes 11 is disposed such that a portion of a vane away from of the center of rotation of the classification rotor 31 is located on more upstream side in a direction of rotation of the classification rotor 31 than a portion of the vane closer to the center of rotation of the classification rotor 31. Each vane 11 has an elbow.

In addition, in a horizontal cross section provided by sectioning the classification rotor 31 in the direction perpendicular to the rotational axis of the classification rotor 31, (i) an angle θ1 is formed between a straight line that connects the center of rotation of the classification rotor 31 to the end of the vane 11 on the side of the center of rotation, and a straight line that connects the end of the vane 11 on the side of the center of rotation with the vane elbow, and the angle θ1 is from 30° to 65°, (ii) using L1 for the distance from the center of rotation of the classification rotor 31 to the end of the vane 11 on the outer circumference side, L2 for the distance from the center of rotation of the classification rotor 31 to the end of the vane 11 on the side of the center of rotation, and L3 for the distance from the center of rotation of the classification rotor 31 to the elbow of the vane 11, the following formula is satisfied:

$$0.65 \leq (L3-L2)/(L1-L2) \leq 0.85,$$

(iii) an angle θ2 is formed between a straight line that connects the end of the vane 11 on the side of the center of rotation to the elbow of the vane 11, and a straight line that connects the elbow of the vane 11 to the end of the vane 11 on the outer circumference side, and the angle θ2 is from 5° to 25°, and (iv) the sum of θ1 and θ2 is from 55° to 85°.

In FIG. 1, reference numeral 12 indicates the upper part of the classification rotor frame and reference numeral 13 indicates the lower part of the classification rotor frame. In addition, the region of a vane 11 from the end on the side of the center of rotation to the elbow may be straight or curved, but straight is preferred as shown in FIG. 1. The region of a vane 11 from the elbow to the end on the outer circumference side may be straight or curved, but straight is preferred as shown in FIG. 1.

When the classification rotor described in the preceding is used, a toner classification apparatus can be provided that, even at a small diameter toner, provides an excellent yield while providing a satisfactory removal of the particles having too small diameter. Here, "particles having too small diameter" in the present disclosure are particles having much smaller diameter than particles to be obtained. The present inventors hypothesize as follows with regard to the causes for this.

The centrifugal force acting on a body is given by [weight of the body]×[radius of gyration]×[square of the angular velocity of the rotational motion]. Here, the radius of gyration of the particles to be classified is considered to be the distance between a particle to be classified and the center of rotation of the classification rotor. As noted above, it is thought that, during the execution of the classification process, a vortex is generated between the vanes of the rapidly rotating classification rotor. The presence of this vortex causes the local occurrence of an air flow that is strongly drawn to the inner side, and this is presumed to cause particles that properly should not be removed to end up also being drawn in and removed. When the vortex is present as far as the inner side of the classification rotor, the particles to be classified are drawn in toward the inner side direction of the classification rotor, the centrifugal force then becomes smaller due to the smaller distance from the center of rotation, and return to the outer side of the classification rotor cannot take place and removal as particles having too small diameter ends up occurring as a result.

The classification rotor is configured such that, in a horizontal cross section provided by sectioning the classification rotor in the direction perpendicular to the rotational axis of the classification rotor, an angle θ1 is formed between the straight line that connects the center of rotation of the classification rotor to the vane end on the side of the center of rotation, and the straight line that connects the vane end on the side of the center of rotation with the vane elbow. In addition, the vane itself has an elbow and an angle θ2 is then formed between the straight line that connects the vane end on the side of the center of rotation to the vane elbow, and the straight line that connects the vane elbow to the vane end on the outer circumference side. It is thought that as a consequence, the position of the vortex that is formed during classification can be pushed to the outer side and that even when a particle that should not be removed is drawn in by the vortex, the particle can return to the outer side of the classification rotor because the centrifugal force has not become small, and the yield is improved as a result.

θ1 must satisfy from 30° to 65°. When θ1 does not satisfy the condition of 30°, the effect whereby the position of vortex occurrence is pushed to the outer side is then inadequate. When θ1 exceeds 65°, the vane-to-vane distance in the neighborhood of the end on the inner side of the classification rotor is too small, and pass through of the particles having too small diameter to be intentionally removed from the particles to be classified then ends up being impeded. θ1 is preferably from 35° to 65° and is more preferably from 45° to 65°.

Figure 2A:
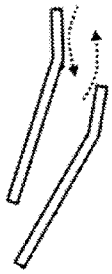
FIGS. 2A to 2C are explanatory diagrams of the air flow between two vanes.
Figure 2B:
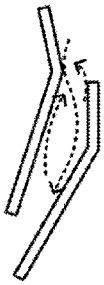

In addition, θ2 must satisfy from 5° to 25°. When θ2 does not satisfy the condition of 5°, the effect whereby the position of vortex occurrence is pushed to the outer side is then inadequate. When θ2 exceeds 25°, the angle exhibited by the vane itself is too steep, and as a consequence a second air flow vortex is generated in the vicinity of the elbow, as shown in FIG. 2B, and due to this the particles end up being drawn farther to the inner side. θ2 is preferably from 10° to 25° and is more preferably from 15° to 20°.

Viewed from the standpoint of pushing the location of vortex occurrence to the outer side to a satisfactory degree, the sum of θ1 and θ2 (θ1+θ2) must be from 55° to 85° and preferably satisfies from 65° to 85° and more preferably from 75° to 85°.

$0.65 \leq (L3-L2)/(L1-L2) \leq 0.85$ must be satisfied where L1 is the distance from the center of rotation of the classification rotor to the vane end on the outer circumference side, L2 is the distance from the center of rotation of the classification rotor to the vane end on the side of the center of rotation, and L3 is the distance from the center of rotation of the classification rotor to the vane elbow.

Figure 2C:
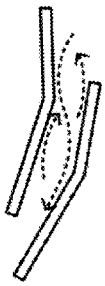

When (L3−L2)/(L1−L2) is greater than 0.85, the elbow is then too near to the outer circumference side of the classification rotor, and because of this the effects associated with θ2 do not appear. When (L3−L2)/(L1−L2) is less than 0.65, the vane then has a long length from the vane end on the outer circumference side to the elbow, and due to this a second air flow vortex is generated as shown in FIG. 2C and particles that should not be removed then end up being drawn farther to the side of the center of rotation of the classification rotor.

The radius of the classification rotor is not particularly limited and can be appropriately modified according to dimension of the classification apparatus, amount of the particles to be classified, and the like. The radius of the classification rotor may be 60 mm to 120 mm, for example.

Moreover, the height of vane of the classification rotor is not particularly limited and can be appropriately modified according to dimensions of the classification apparatus and the classification rotor, amount of the particles to be classified, and the like. The height of vane of the classification rotor may be 50 mm to 100 mm, for example.

Further, the number of vane of the classification rotor is not particularly limited and can be appropriately modified according to dimensions of the classification apparatus and the classification rotor, amount of the particles to be classified, and the like. The number of vane of the classification rotor may be 20 to 60, for example.

Furthermore, the gap between ends of vanes disposed in the classification rotor on outer circumference side thereof is not particularly limited and can be appropriately modified according to dimension of the classification apparatus, amount of the particles to be classified, and the like.

For example, the gap between ends of vanes disposed in the classification rotor on outer circumference side thereof may be 25 mm or less from the standpoint of preventing enlargement of air flow vortex generated between vanes disposed in the classification rotor. In addition, the gap between ends of vanes disposed in the classification rotor on outer circumference side thereof may be 5 mm or more from the standpoint of preventing the time required for processing from becoming longer due to the narrowing of the opening.

The toner classification apparatus should have the classification rotor described above in order to remove the particles having too small diameter in the particles to be classified, but is not otherwise particularly limited, and the main unit of the toner classification apparatus may have, for example, supply means for supplying the particles to be classified, recovery means for the classified material post-classification processing, and so forth. As the particle diameter of the particles to be classified declines, the number of particles per unit weight increases and due to this the number of particle-to-particle contact points increases and aggregates are then more easily formed.

Figure 3:
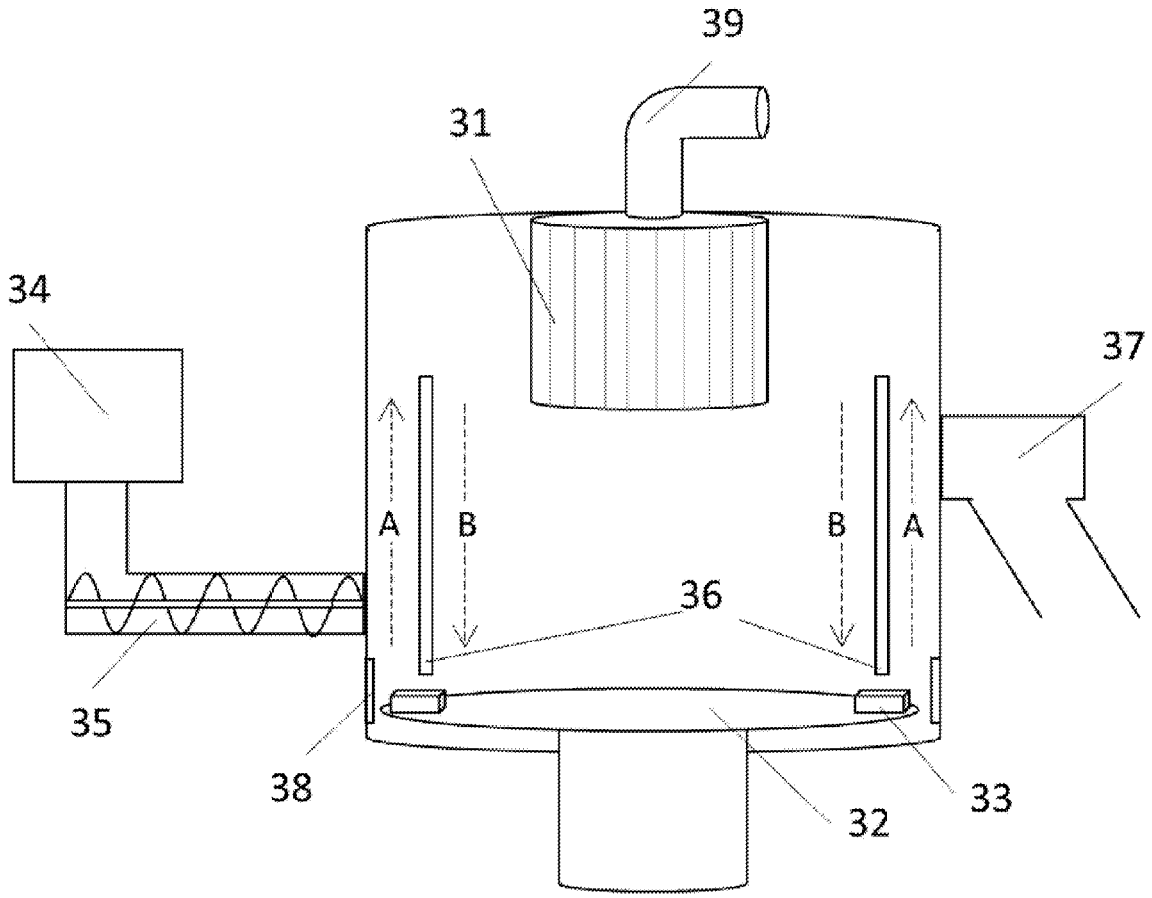
FIG. 3 is a schematic diagram of a toner classification apparatus used in the examples.

From the standpoint of being able to proceed with the classification step while breaking down these aggregates, the toner classification apparatus preferably has, as shown in FIG. 3,

- a cylindrical body casing;
- the aforementioned classification rotor 31;
- cylindrical guide means 36 disposed in a state of overlapping at least a portion of the classification rotor;
- an introduction port 34 for particles to be classified and supply means 35 for the particles to be classified that has the introduction port 34 for particles to be classified, these being formed in a side surface of the body casing in order to introduce the particles to be classified;
- particles having too small diameter discharge port 39 and a classified particle take-off port 37, these being formed in a side surface of the body casing in order to discharge, from the body casing, classified particles from which the particles having too small diameter have been excluded; and
- a dispersion rotor 32 that is a rotating body attached within the body casing to the central rotational axle and that has a dispersion hammer (for example, a rectangular block) 33 on the side surface of the classification rotor 31 side of the dispersion rotor 32.

The body casing and the guide means 36 are not limited to cylindrical shapes and may assume any shape.

Due to the presence of the guide means 36, an ascending air flow, directed toward the classification rotor 31, is produced in a first space A, and a descending air flow, directed to the side of the dispersion rotor 32, is produced in a second space B. It is thought that this enables the classification process to be carried out while the dispersion hammer 33 breaks up aggregates of the particles to be classified. As long as the dispersion hammer 33 can break up aggregates of the particles to be classified, it is not otherwise limited to a rectangular block and may assume any shape.

Moreover, from the standpoint of being able to improve the flowability by raising the average circularity of the toner, more preferably a liner 38 is disposed in a fixed manner at the circumference of the dispersion rotor 32 while maintaining a distance therefrom. The liner 38 is preferably provided with grooves in the surface that faces the dispersion rotor 32.

It is thought that when the particles to be classified undergo impact with, e.g., the rotating dispersion hammers and the surface of the liner facing the dispersion hammers, protruded portions on the particles to be classified are flattened and the circularity is raised as a result. When the efficiency of removing particles having too small diameter during classification is low, the circularity-improving effect on the particles may be reduced—due to the persistence of a condition in which a large number of particles to be classified are present within the casing—as compared to that when the efficiency of removing particles having too small diameter is high.

The toner classification apparatus may be applied to the powder particles provided by known production methods, e.g., the melt-kneading/pulverization method, suspension polymerization method, emulsion aggregation method, dissolution suspension method, and so forth, but is advantageously used in particular in the melt-kneading/pulverization method in view of the ease of production of particles having too small diameter when smaller toner particle diameters are sought. A procedure for producing toner by the melt-kneading/pulverization method is described in the following, but there is no limitation to or by the following procedure.

Toner particle production method: First, in a starting material mixing step, at least a binder resin is weighed out in prescribed amounts as the toner starting material and is blended and mixed. The following, for example, may also be admixed as necessary: colorant, a release agent that suppresses the occurrence of hot offset when the toner is heated and fixed, a dispersing agent that disperses the release agent, a charge control agent, and so forth. The mixing apparatus can be exemplified by the double cone mixer, V-mixer, drum mixer, Super mixer, Henschel mixer, and Nauta mixer.

Then, in a melt-kneading step, the toner starting materials blended and mixed in the starting material mixing step are melt-kneaded and the resins are melted and the colorant and so forth are dispersed therein. For example, a batch kneader, e.g., a pressure kneader, Banbury mixer, and so forth, or a continuous kneader can be used in this melt-kneading step. Single-screw and twin-screw extruders have become the main stream in recent years because they offer the advantages of, e.g., enabling continuous production, and, for example, a Model KTK twin-screw extruder from Kobe Steel, Ltd., a Model TEM twin-screw extruder from Toshiba Machine Co., Ltd., a twin-screw extruder from KCK, a Co-Kneader from Buss AG, and so forth are commonly used. After melt-kneading, the melt-kneaded material provided by melting-kneading the toner starting materials is rolled out using, for example, a two-roll mill, and cooled in a cooling step of cooling by, for example, water cooling.

The cooled melt-kneaded material provided by the cooling step is then pulverized to a desired particle diameter in a pulverization step. A coarse pulverization with, e.g., a crusher, hammer mill, feather mill, and so forth, is first carried out in the pulverization step. A pulverized material is then obtained by carrying out a fine pulverization using a mechanical pulverizer, e.g., Inomizer (Hosokawa Micron Corporation), Kryptron (Kawasaki Heavy Industries, Ltd.), Super Rotor (Nisshin Engineering Inc.), Turbo Mill (Turbo Kogyo Co., Ltd.), and so forth. Such a stagewise pulverization is performed in the pulverization step to the prescribed toner particle size.

Using the pulverized material provided by the pulverization step as the particles to be classified, a toner particle is obtained by carrying out a classification process (classification step), using the toner classification apparatus, on the particles to be classified. The obtained toner particle may be used as such as toner, but, in order to provide functionalities required of toner, may be made into toner optionally by the addition of inorganic fine particles, e.g., silica, to the toner particle, followed by, e.g., the execution of a thermal spheronizing treatment.

In order to support an improved toner transferability, the average circularity of the toner is preferably at least 0.955 and is more preferably at least 0.960. The average circularity is preferably not more than 0.990 based on a consideration of preventing poor cleaning.

In addition, the weight-average particle diameter of the toner is preferably a small particle diameter from the standpoint of increasing the image quality of the image formed by the toner, and specifically from 3.50 μm to 6.00 μm is preferred and from 3.50 μm to 5.00 μm is more preferred. While small weight-average particle diameters are preferred for the toner, values of at least 3.50 μm largely prevent this parameter from contributing to image defects due to escape past the cleaning blade.

The number % of 3.0 μm or less in the toner is preferably not more than 20.0 number %, more preferably not more than 15.0 number %, and still more preferably not more than 10.0 number %.

Toner starting materials: The starting materials are described in the following for a toner that contains at least a binder resin.

Binder resin: Common resins can be used for the binder resin, for example, polyester resins, styrene-acrylic acid copolymers, polyolefin resins, vinyl resins, fluororesins, phenolic resins, silicone resins, and epoxy resins. Among the preceding, amorphous polyester resins are preferred from the standpoint of providing a good low-temperature fixability. The combination of a low molecular weight polyester resin with a high molecular weight polyester resin may be used based on a consideration of the coexistence of the low-temperature fixability with the hot offset resistance. Viewed from the standpoint of the blocking resistance during storage and obtaining additional improvements in the low-temperature fixability, a crystalline polyester resin may also be used as a plasticizer.

Colorant: The toner starting materials can include a colorant. The following are examples of colorants that can be included in the toner starting materials.

The colorant can be exemplified by known organic pigments and oil-based dyes, carbon black, magnetic bodies, and so forth. A single colorant may be used by itself or at least two thereof may be used in combination.

Cyan colorants can be exemplified by copper phthalocyanine compounds and derivatives thereof, anthraquinone compounds, and basic dye lake compounds.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Yellow colorants can be exemplified by condensed azo compounds, isoindolinone compounds, anthraquinone compounds, azo-metal complexes, methine compounds, and allylamide compounds.

Black colorants can be exemplified by carbon black and magnetic bodies and by black colorants provided by color mixing using the aforementioned yellow colorants, magenta colorants, and cyan colorants to give a black color.

Release agent: A release agent may be used on an optional basis to suppress the appearance of hot offset when the toner is heated and fixed. This release agent can be generally exemplified by low molecular weight polyolefins, silicone waxes, fatty acid amides, ester waxes, carnauba wax, and hydrocarbon waxes.

The methods used to measure the various properties of the starting materials and toner are described in the following.

Method for measuring the weight-average particle diameter (D4) of the toner: The weight-average particle diameter (D4) of the toner is determined by carrying out the measurements in 25,000 channels for the number of effective measurement channels and performing analysis of the measurement data using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.) to set the measurement conditions and analyze the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis. In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte solution is set to ISOTON II; and a check is entered for the post-measurement aperture tube flush. In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm. The specific measurement procedure is as follows.

(1) Approximately 200 mL of the above-described aqueous electrolyte solution is introduced into a 250 mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the analysis software.

(2) Approximately 30 mL of the aqueous electrolyte solution is introduced into a 100 mL flatbottom glass beaker, and to this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), an ultrasound disperser having an electrical output of 120 W and equipped with two oscillators (oscillation frequency=50 kHz) disposed such that the phases are displaced by 180°, and approximately 2 mL of Contaminon N is added to the water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for measuring the number % of 3.0 μm or less in the toner: When set to graph/number % with the dedicated software in step (7) in the method for measuring the weight-average particle diameter (D4) of the toner, the cumulative value for the number % in the particle diameter region of 3.0 μm or less is the number % of 3.0 μm or less.

Method for measuring the average circularity: The average circularity of the toner is measured using an "FPIA-3000" (Sysmex Corporation), a flow particle image analyzer, and using the measurement and analysis conditions from the calibration process. The specific measurement procedure is as follows. First, approximately 20 mL of deionized water—from which, e.g., solid impurities have been removed in advance—is introduced into a glass vessel. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. Using a benchtop ultrasound cleaner/disperser that has an oscillation frequency of 50 kHz and an electrical output of 150 W ("VS-150" (Velvo-Clear Co., Ltd.)) as the ultrasound disperser, a prescribed amount of deionized water is introduced into the water tank and approximately 2 mL of Contaminon N is added to the water tank.

The previously cited flow particle image analyzer fitted with an objective lens (10×) was used for the measurement, and "PSE-900A" (Sysmex Corporation) particle sheath was used for the sheath solution. The dispersion adjusted according to the procedure described above is introduced into the flow particle image analyzer and 3,000 toner particles are measured according to total count mode in HPF measurement mode. The average circularity of the toner particle is determined with the binarization threshold value during particle analysis set at 85% and the analyzed particle diameter limited to a circle-equivalent diameter of from 1.985 μm to less than 39.69 μm.

For this measurement, automatic focal point adjustment is performed prior to the start of the measurement using reference latex particles (a dilution with deionized water of "RESEARCH AND TEST PARTICLES Latex Microsphere Suspensions 5200A", Duke Scientific Corporation). After this, focal point adjustment is preferably performed every two hours after the start of measurement.

In the examples in the present application, the flow particle image analyzer used had been calibrated by the Sysmex Corporation and had been issued a calibration certificate by the Sysmex Corporation. The measurements were carried out using the measurement and analysis conditions when the calibration certification was received, with the exception that the analyzed particle diameter was limited to a circle-equivalent diameter of from 1.985 μm to less than 39.69 μm.

EXAMPLES

The present disclosure is described in additional detail in the following using examples and comparative examples, but these do not limit the embodiments according to the present disclosure. Unless specifically indicated otherwise, the number of parts given in the following in the examples and comparative examples are on a mass basis in all instances.

Binder Resin Production Example polyoxypropylene(2.2)-2,2-bis(4-hydroxyphenyl)propane: 72.0 parts (100 mol % with reference to the total number of moles of polyhydric alcohol)

terephthalic acid: 28.0 parts (96 mol % with reference to the total number of moles of polybasic carboxylic acid)

tin 2-ethylhexanoate (esterification catalyst): 0.5 parts

These materials were metered into a reactor equipped with a condenser, stirrer, nitrogen introduction line, and thermocouple. The interior of the flask was then substituted with nitrogen gas, the temperature was subsequently gradually raised while stirring, and a reaction was run for 8 hours while stirring at a temperature of 220° C. The pressure in the reactor was then reduced to 8.3 kPa, holding was carried out for 1 hour, cooling to 180° C. was thereafter implemented, and return to atmospheric pressure was carried out.

trimellitic anhydride: 1.3 parts (4 mol % with reference to the total number of moles of polybasic carboxylic acid)

tert-butylcatechol (polymerization inhibitor): 0.1 parts

These materials were subsequently added, the pressure in the reactor was dropped to 8.3 kPa, and a reaction was run for 1 hour while maintaining a temperature of 180° C. to obtain a binder resin (amorphous polyester resin). The softening point of the resulting binder resin, as measured in accordance with ASTM D 36-86, was 110° C.

Example of Production of Pulverized Particles for Use as Toner (Particles to be Classified)

| | |
|---|---|
| binder resin | 90 parts |
| Fischer-Tropsch wax (hydrocarbon wax, melting point = 90° C.) | 5 parts |
| C.I. Pigment Blue 15:3 | 5 parts |

These materials were mixed using a Henschel mixer (Model FM-75, Mitsui Mining Co., Ltd.) at a rotation rate of 20 $s^{-1}$ and a rotation time of 5 minutes, and were then kneaded with a twin-screw kneader (Model PCM-30, Ikegai Corporation). The barrel temperature during kneading was set so as to provide an outlet temperature for the kneadate of 120° C. The outlet temperature of the kneadate was directly measured using an HA-200E handheld thermometer from Anritsu Meter Co., Ltd. The resulting kneadate was cooled and coarsely pulverized using a hammer mill to a volume-average particle diameter of not greater than 100 μm to provide a coarsely pulverized material.

A finely pulverized material was obtained by subjecting this coarsely pulverized material to pulverization using a mechanical pulverizer (Turbo Mill T250-CRS, rotor configuration: RS type, from Turbo Kogyo Co., Ltd.) and conditions of a rotor rotation rate of 12,000 rpm and a pulverization feed of 10 kg/h. The pulverized particles for use as toner (particles to be classified) were obtained by subjecting this finely pulverized material to additional pulverization using conditions of a rotor rotation rate of 12,000 rpm and a pulverization feed of 10 kg/h. The particles to be classified had a weight-average particle diameter of 4.40 μm, a number % of 3.0 μm or less of 42.5%, and an average circularity of 0.952.

Toner Classification Apparatus

The toner classification apparatus shown in FIG. 3 was used for the structure of the toner classification apparatus. This toner classification apparatus is constituted of the following:

- a cylindrical body casing;
- a disk-shaped dispersion rotor 32 that rotates at high speed and is a rotating body attached in the body casing to a central rotational axle, and that has a plurality of dispersion hammers 33 on the side surface of the rotating body on the classification rotor side;
- a liner 38 that is disposed at the circumference of the dispersion rotor 32 while maintaining a distance therefrom;
- a classification rotor 31, which is means for the classification of particles to be classified;
- particles having too small diameter discharge port 39 for the discharge and removal of particles of not more than a prescribed particle diameter and selected by the classification rotor 31;
- a cooling wind introduction port (not shown) for the introduction of a cooling wind from below the dispersion rotor;
- an introduction port 34 for the particles to be classified and supply means 35 for the particles to be classified that has the introduction port 34 for the particles to be classified, for the introduction of the particles to be classified into the interior of the body casing;
- a classified particle take-off port 37 for discharging the classified particles after the classification process; and
- cylindrical guide means 36 disposed in a state of overlapping at least a portion of the classification rotor 31.

The guide means 36 partitions the space of the body casing in the toner classification apparatus into a space A, where an air current is produced in a direction that introduces the particles to be processed to the classification rotor 31, and a space B, where an air current is produced in the direction that introduces the particles to be processed to between the dispersion rotor 32 and the liner 38.

Figure 4:
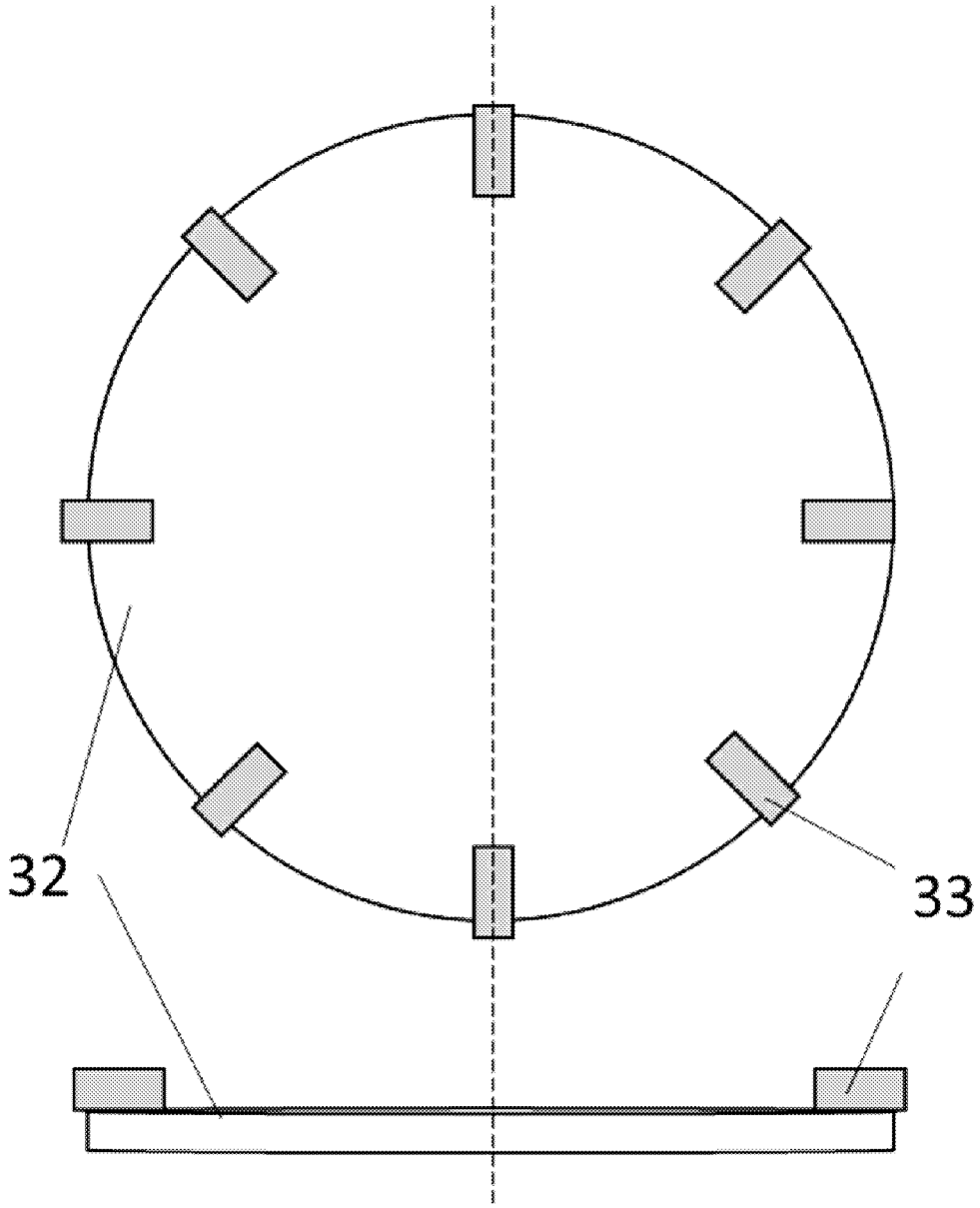
FIG. 4 is a schematic diagram of a dispersion rotor used in the examples.

The height of the space in the body casing was 300 mm and the internal diameter was 300 mm. The outer diameter of the dispersion rotor was 285 mm, eight dispersion hammers were attached on the dispersion rotor as shown in FIG. 4, and the length/width/height of each dispersion hammer was 30 mm/20 mm/20 mm.

Figure 5:
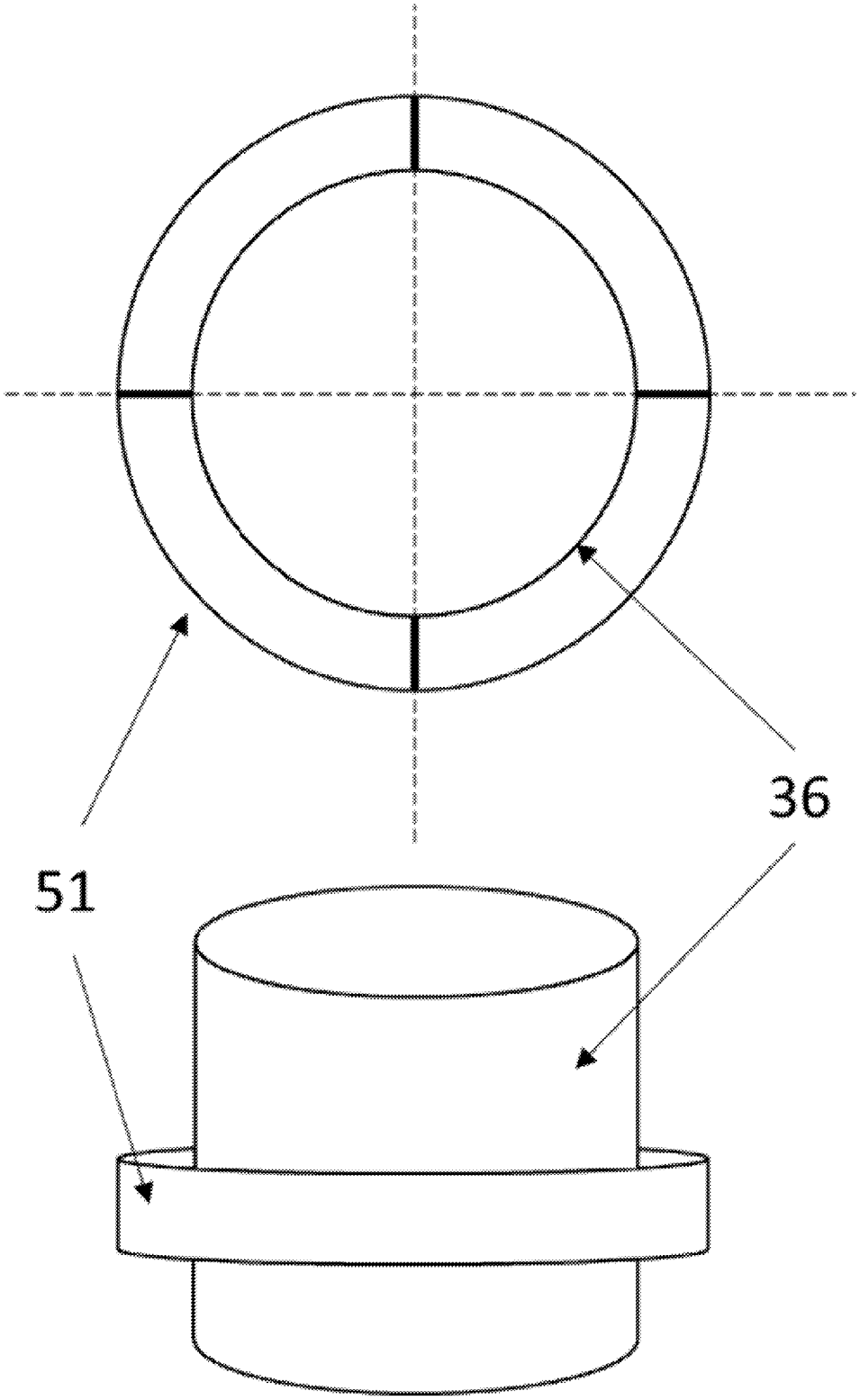
FIG. 5 is a schematic diagram of guide means used in the examples.

As shown in FIG. 5, the cylindrical guide means was connected to a guide means support member 51 and could be installed at any position by connecting the guide means support member to the body casing using, e.g., screws. The diameter of the guide means was 250 mm and its height was 230 mm, and the distance between the upper end of the guide means and the upper end of the casing was 20 mm.

Exemplary Classification Rotor 1

Exemplary classification rotor 1 had the shape shown in FIG. 1, a θ1 of 35°, a θ2 of 23°, an L1 of 82 mm, an L2 of 57 mm, an L3 of 76 mm, and a height of the classification rotor opening of 88 mm. There were 30 vanes.

Exemplary Classification Rotors 2 to 8 and Comparative Classification Rotors 1 to 10

The differences from exemplary classification rotor 1 are given in Table 1 for exemplary classification rotors 2 to 8 and comparative classification rotors 1 to 10.

TABLE 1

| | θ1 [°] | θ2 [°] | θ1 + θ2 [°] | L1 [mm] | L2 [mm] | L3 [mm] | [ L3-L2]/ [L1-L2] | Number of vanes | Gap between vane and end thereof on outer circumference side [mm] |
|---|---|---|---|---|---|---|---|---|---|
| Exemplary classification rotor 1 | 35 | 23 | 58 | 82 | 57 | 76 | 0.76 | 30 | 15.2 |
| Exemplary classification rotor 2 | 40 | 20 | 60 | 82 | 57 | 76 | 0.76 | 30 | 15.2 |
| Exemplary classification rotor 3 | 60 | 10 | 70 | 82 | 57 | 76 | 0.76 | 30 | 15.2 |
| Exemplary classification rotor 4 | 60 | 20 | 80 | 82 | 57 | 74 | 0.68 | 30 | 15.2 |
| Exemplary classification rotor 5 | 60 | 20 | 80 | 82 | 57 | 76 | 0.76 | 30 | 15.2 |
| Exemplary classification rotor 6 | 60 | 20 | 80 | 82 | 57 | 78 | 0.84 | 30 | 15.2 |
| Exemplary classification rotor 7 | 60 | 20 | 80 | 82 | 57 | 78 | 0.84 | 40 | 10.9 |
| Exemplary classification rotor 8 | 60 | 20 | 80 | 82 | 57 | 78 | 0.84 | 25 | 18.6 |
| Comparative classification rotor 1 | 30 | 30 | 60 | 82 | 57 | 76 | 0.76 | 30 | 15.2 |
| Comparative classification rotor 2 | 60 | 30 | 90 | 82 | 57 | 76 | 0.76 | 30 | 15.2 |
| Comparative classification rotor 3 | 20 | 23 | 43 | 82 | 57 | 76 | 0.76 | 30 | 15.2 |
| Comparative classification rotor 4 | 75 | 10 | 85 | 82 | 57 | 76 | 0.76 | 30 | 15.2 |
| Comparative classification rotor 5 | 55 | 3 | 58 | 82 | 57 | 76 | 0.76 | 30 | 15.2 |
| Comparative classification rotor 6 | 60 | 0 | 60 | 82 | 57 | — | — | 30 | 15.2 |
| Comparative classification rotor 7 | 80 | 0 | 80 | 82 | 57 | — | — | 30 | 15.2 |
| Comparative classification rotor 8 | 60 | 20 | 80 | 82 | 57 | 73 | 0.64 | 30 | 15.2 |
| Comparative classification rotor 9 | 60 | 20 | 80 | 82 | 57 | 80 | 0.92 | 30 | 15.2 |
| Comparative classification rotor 10 | 0 | 0 | 0 | 82 | 57 | — | — | 30 | 15.2 |
| Comparative classification rotor 11 | 32 | 28 | 60 | 82 | 57 | 76 | 0.76 | 30 | 15.2 |
| Comparative classification rotor 12 | 40 | 10 | 50 | 82 | 57 | 76 | 0.76 | 30 | 15.2 |
| Comparative classification rotor 13 | 64 | 23 | 87 | 82 | 57 | 76 | 0.76 | 30 | 15.2 |

Liners

Figure 6:
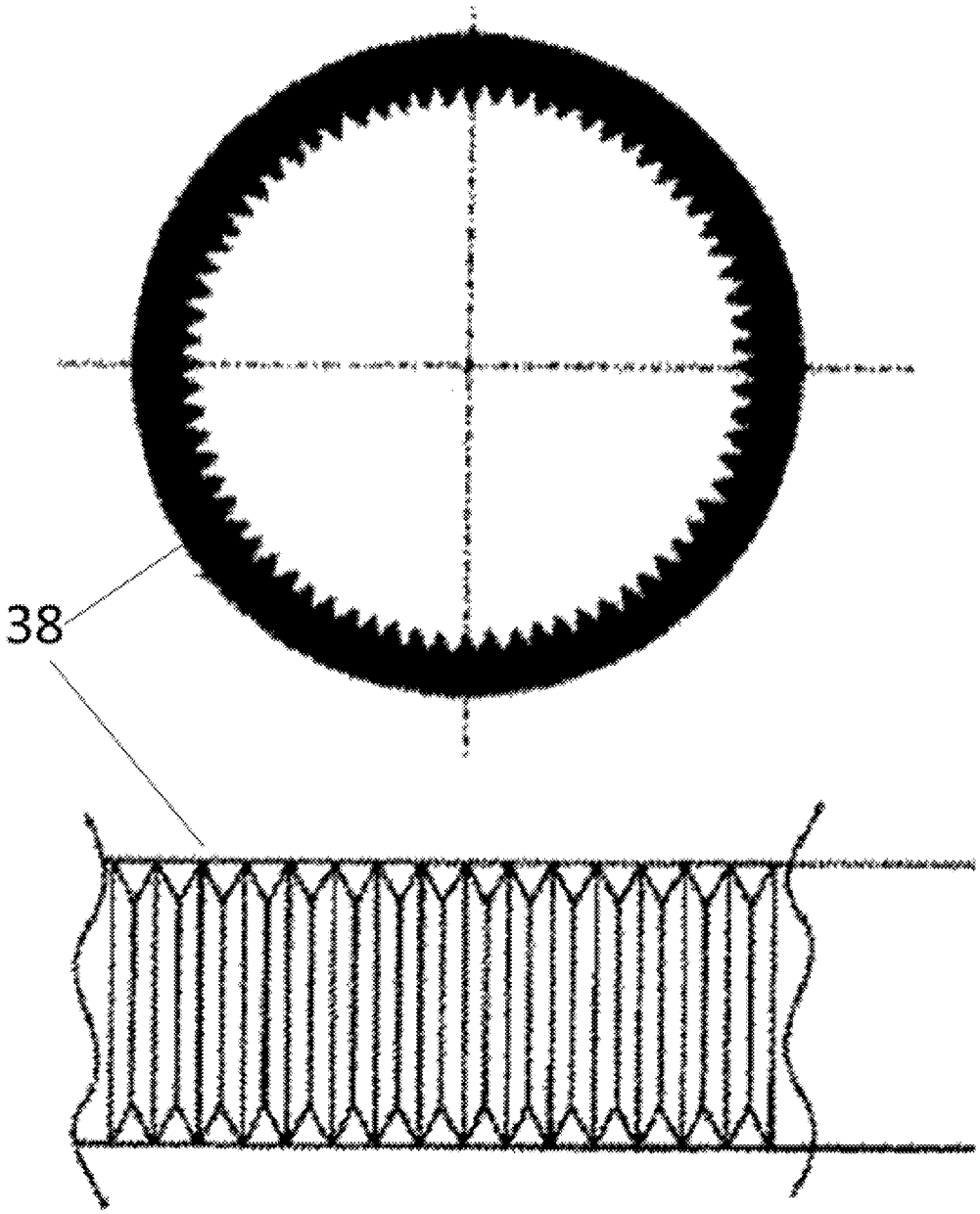
FIG. 6 is a schematic diagram of a liner used in the examples.

Liner 1 had a plurality of protruded portions as shown in FIG. 6 and had a depressed portion formed between two protruded portions. This unevenness had a triangular shape, and the repeat distance from protruded portion to protruded portion was 3 mm, the depth of the depressed portions was 3.0 mm, and the height of the liner was 50 mm. Liner 2 lacked the surface unevenness of liner 1 and had a smooth surface.

Toner Production Method Example 1

Exemplary classification rotor 1 and liner 2 were installed in the toner classification apparatus and a toner 1 was obtained using the following conditions by performing 60 cycles of classification processing using the pulverized particles for use as toner for the particles to be classified: a classification rotor rotation rate of 9,000 rpm, a dispersion rotor rotation rate of 5,000 rpm, a blower flow rate of 10 $m^3$/min, a classification cycle of 60 seconds (10 seconds for the time for introduction of the particles to be classified, 30 seconds for the classification processing time, and 20 seconds for the time for recovery of the classified material post-processing), and 200 g for the amount of introduction of particles to be classified per 1 cycle. Toners 2 to 9 and comparative toners 1 to 10 were obtained by changing the conditions as shown in Table 2.

TABLE 2

| | Classification rotor | Liner |
|---|---|---|
| Toner 1 | exemplary classification rotor 1 | Liner 2 |
| Toner 2 | exemplary classification rotor 2 | Liner 2 |
| Toner 3 | exemplary classification rotor 3 | Liner 2 |
| Toner 4 | exemplary classification rotor 4 | Liner 2 |
| Toner 5 | exemplary classification rotor 5 | Liner 2 |
| Toner 6 | exemplary classification rotor 6 | Liner 2 |

TABLE 2-continued

| | Classification rotor | Liner |
|---|---|---|
| Toner 7 | exemplary classification rotor 6 | Liner 1 |
| Toner 8 | exemplary classification rotor 7 | Liner 2 |
| Toner 9 | exemplary classification rotor 8 | Liner 2 |
| Comparative toner 1 | comparative classification rotor 1 | Liner 2 |
| Comparative toner 2 | comparative classification rotor 2 | Liner 2 |
| Comparative toner 3 | comparative classification rotor 3 | Liner 2 |
| Comparative toner 4 | comparative classification rotor 4 | Liner 2 |
| Comparative toner 5 | comparative classification rotor 5 | Liner 2 |
| Comparative toner 6 | comparative classification rotor 6 | Liner 2 |
| Comparative toner 7 | comparative classification rotor 7 | Liner 2 |
| Comparative toner 8 | comparative classification rotor 8 | Liner 2 |
| Comparative toner 9 | comparative classification rotor 9 | Liner 2 |
| Comparative toner 10 | comparative classification rotor 10 | Liner 2 |
| Comparative toner 11 | comparative classification rotor 11 | Liner 2 |
| Comparative toner 12 | comparative classification rotor 12 | Liner 2 |
| Comparative toner 13 | comparative classification rotor 13 | Liner 2 |

Example 1

Toner 1 was subjected to evaluation of the average circularity and weight-average particle diameter D4 and the number % of 3.0 μm or less by measurement of its particle size distribution. The classification yield was determined from the amount of introduction of the particles to be classified (200 g×60 cycles) and the weight of the obtained toner 1.

Criteria for Evaluation of the Yield

A: the yield is at least 70%

B: the yield is at least 60% and less than 70%

C: the yield is at least 50% and less than 60% D: the yield is less than 50%

Criteria for Evaluation of the Number % of 3.0 μm or Less

A: not more than 10.0 number %

B: greater than 10.0 number % and not more than 15.0 number %

C: greater than 15.0 number % and less than 20.0 number %

D: at least 20.0 number %

Criteria for Evaluation of the Average Circularity

A: the average circularity is at least 0.960

B: the average circularity is at least 0.955 and less than 0.960

C: the average circularity is less than 0.955

Examples 2 to 9 and Comparative Examples 1 to 10

The evaluations were performed as in Example 1, but changing the toner as shown in Table 3. The results of the evaluations are given in Table 3.

TABLE 3

| | | yield (%) | | D4 (μm) | number % of 3.0 μm or less | | average circularity | |
|---|---|---|---|---|---|---|---|---|
| Example 1 | toner 1 | 55 | C | 4.78 | 18.2 | C | 0.956 | B |
| Example 2 | toner 2 | 56 | C | 4.79 | 15.5 | C | 0.957 | B |
| Example 3 | toner 3 | 62 | B | 4.72 | 14.3 | B | 0.957 | B |
| Example 4 | toner 4 | 68 | B | 4.73 | 11.1 | B | 0.958 | B |
| Example 5 | toner 5 | 72 | A | 4.82 | 7.8 | A | 0.957 | B |
| Example 6 | toner 6 | 73 | A | 4.80 | 5.8 | A | 0.958 | B |
| Example 7 | toner 7 | 73 | A | 4.81 | 6.2 | A | 0.962 | A |
| Example 8 | toner 8 | 73 | A | 4.79 | 8.5 | A | 0.956 | B |
| Example 9 | toner 9 | 71 | A | 4.83 | 6.2 | A | 0.957 | B |
| Comparative Example 1 | comparative toner 1 | 46 | D | 4.72 | 21.2 | D | 0.956 | B |
| Comparative Example 2 | comparative toner 2 | 45 | D | 4.75 | 17.8 | C | 0.956 | B |
| Comparative Example 3 | comparative toner 3 | 38 | D | 4.91 | 18.0 | C | 0.956 | B |
| Comparative Example 4 | comparative toner 4 | 80 | A | 4.61 | 32.2 | D | 0.954 | C |
| Comparative Example 5 | comparative toner 5 | 40 | D | 4.75 | 18.5 | C | 0.956 | B |
| Comparative Example 6 | comparative toner 6 | 45 | D | 4.75 | 21.5 | D | 0.956 | B |
| Comparative Example 7 | comparative toner 7 | 77 | A | 4.62 | 28.9 | D | 0.954 | C |
| Comparative Example 8 | comparative toner 8 | 42 | D | 4.82 | 20.5 | D | 0.956 | B |
| Comparative Example 9 | comparative toner 9 | 45 | D | 4.88 | 17.8 | C | 0.957 | B |
| Comparative Example 10 | comparative toner 10 | 5 | D | 5.51 | 8.0 | A | 0.957 | B |
| Comparative Example 11 | comparative toner 11 | 45 | D | 4.73 | 21.5 | D | 0.955 | B |
| Comparative Example 12 | comparative toner 12 | 40 | D | 4.77 | 18.2 | C | 0.956 | B |
| Comparative Example 13 | comparative toner 13 | 79 | A | 4.63 | 31.9 | D | 0.954 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-107170, filed Jun. 22, 2020, Japanese Patent Application No. 2021-082036, filed May 14, 2021 which are hereby incorporated by reference herein in their entirety.

What is claimed is:

1. A toner classification apparatus comprising a classification rotor supported for rotation in a direction of rotation in order to carry out a classification process, wherein the classification rotor comprises a plurality of vanes that extend from a side of a center of rotation of the classification rotor to an outer circumference side of the classification rotor;

the plurality of vanes are disposed with prescribed gaps established between the vanes;

the gaps form an opening that faces a region of the center of rotation of the classification rotor;

each of the vanes is disposed such that a portion of a vane away from the center of rotation of the classification rotor is located on a more upstream side in the direction of rotation of the classification rotor than a portion of the vane closer to the center of rotation of the classification rotor;

each of the vanes has an elbow; and in a horizontal cross section provided by sectioning the classification rotor in a direction perpendicular to a rotational axis of the classification rotor, (i) an angle θ1 is formed between a straight line that connects the center of rotation of the classification rotor to the vane end on the side of the center of rotation, and a straight line that connects the vane end on the side of the center of rotation to the vane elbow, with the angle θ1 being from 30° to 65°, (ii) using L1 for a distance from the center of rotation of the classification rotor to the vane end on the outer circumference side, L2 for a distance from the center of rotation of the classification rotor to the vane end on the side of the center of rotation, and L3 for a distance from the center of rotation of the classification rotor to the vane elbow, formula below is satisfied:

$$0.65 \leq (L3-L2)/(L1-L2) \leq 0.85,$$

(iii) an angle θ2 is formed between a straight line that connects the vane end on the side of the center of rotation to the vane elbow, and a straight line that connects the vane elbow to the vane end on the outer circumference side, with the angle θ2 being from 5° to 25°, and (iv) a sum of the θ1 and the θ2 is from 55° to 85°.

2. The toner classification apparatus according to the claim 1, wherein the sum of the θ1 and the θ2 is from 65° to 85°.

3. The toner classification apparatus according to claim 1, further comprising:

a body casing;

guide means disposed in a state of overlapping at least a portion of the classification rotor;

an introduction port for particles to be classified and supply means for the particles to be classified that comprises the introduction port for particles to be classified, these being formed in a side surface of the body casing to introduce the particles to be classified;

particles having too small diameter discharge port and a classified particle take-off port, these being formed in a side surface of the body casing to discharge, to outside of the body casing, classified particles from which the particles having too small diameter have been excluded; and a dispersion rotor that is a rotating body attached, within the body casing, to a central rotational axle and that comprises a dispersion hammer on the side surface of the classification rotor side of the dispersion rotor.

4. The toner classification apparatus according to claim 3, further comprising a liner that faces the dispersion rotor while maintaining a distance therefrom, wherein the liner is fixed on an inner side surface of the body casing.

5. The toner classification apparatus according to claim 4, wherein grooves are disposed in a surface of the liner, the surface facing the dispersion rotor.

6. A toner production method comprising a classification step of carrying out a classification process on particles to be classified by using a toner classification apparatus, wherein the toner classification apparatus comprises a classification rotor supported for rotation, wherein the classification process is carried out by rotating the classification rotor in a direction of rotation, the classification rotor comprises a plurality of vanes that extend from a side of a center of rotation of the classification rotor to an outer circumference side of the classification rotor, the plurality of vanes are disposed with prescribed gaps established therebetween, the gaps form an opening that faces a region of the center of rotation of the classification rotor, each of the vanes is disposed such that a portion of a vane away from the center of rotation of the classification rotor is located on a more upstream side in the direction of rotation of the classification rotor than a portion of the vane closer to the center of rotation of the classification rotor;

each of the vanes has an elbow, and in a horizontal cross section provided by sectioning the classification rotor in a direction perpendicular to a rotational axis of the classification rotor, (i) an angle θ1 is formed between a straight line that connects the center of rotation of the classification rotor to the vane end on the side of the center of rotation, and a straight line that connects the vane end on the side of the center of rotation with the vane elbow, with the angle θ1 being from 30° to 65°, (ii) using L1 for a distance from the center of rotation of the classification rotor to the vane end on the outer circumference side, L2 for a distance from the center of rotation of the classification rotor to the vane end on the side of the center of rotation, and L3 for a distance from the center of rotation of the classification rotor to the vane elbow, formula below is satisfied:

$$0.65 \leq (L3-L2)/(L1-L2) \leq 0.85,$$

(iii) an angle θ2 is formed between a straight line that connects the vane end on the side of the center of rotation to the vane elbow, and a straight line that connects the vane elbow to the vane end on the outer circumference side, with the angle θ2 being from 5° to 25°, and (iv) a sum of the θ1 and the θ2 is from 55° to 85°.

7. The toner production method according to the claim 6, wherein the sum of θ1 and θ2 is from 65° to 85°.

8. The toner production method according to claim 6, wherein the toner classification apparatus further comprises:

a body casing;

guide means disposed in a state of overlapping at least a portion of the classification rotor;

an introduction port for particles to be classified and supply means for the particles to be classified that comprises the introduction port for particles to be classified, these being formed in a side surface of the body casing to introduce the particles to be classified;

particles having too small diameter discharge port and a classified particle take-off port, these being formed in a side surface of the body casing to discharge, to outside of the body casing, classified particles from which the particles having too small diameter have been excluded; and a dispersion rotor that is a rotating body attached, within the body casing, to a central rotational axle and that comprises a dispersion hammer on the side surface of the classification rotor side of the dispersion rotor.

9. The toner production method according to claim 8, further comprising a liner that faces the dispersion rotor while maintaining a distance therefrom, wherein the liner is fixed on an inner side surface of the body casing.

10. The toner production method according to claim 9, wherein grooves are disposed in a surface of the liner, the surface facing the dispersion rotor.

* * * * *